United States Patent [19]

Uchida

[11] Patent Number: 4,533,235

[45] Date of Patent: Aug. 6, 1985

[54] CLEANING DEVICE FOR USE IN AN IMAGE FORMING APPARATUS

[75] Inventor: Kohachi Uchida, Sagamihara, Japan

[73] Assignee: Tokyo Shibaura Denki Kabushiki Kaisha, Japan

[21] Appl. No.: 452,867

[22] Filed: Dec. 23, 1982

[30] Foreign Application Priority Data

Feb. 3, 1982 [JP] Japan ..... 57-14850

[51] Int. Cl.[3] ..... G03G 21/00

[52] U.S. Cl. ..... 355/15; 15/256.52; 118/652

[58] Field of Search ..... 355/15, 3 R, 3 DD; 15/256.51, 256.52; 118/652

[56] References Cited

U.S. PATENT DOCUMENTS

| | | | |
|---|---|---|---|
| 4,181,425 | 1/1980 | Higaya et al. | 355/15 |
| 4,371,257 | 2/1983 | Nishikawa | 355/3 DD |
| 4,386,577 | 7/1983 | Hosono et al. | 355/3 DD |

*Primary Examiner*—R. L. Moses

*Attorney, Agent, or Firm*—Cushman, Darby & Cushman

[57] ABSTRACT

A cleaning device cleans an image forming body by removing residual magnetic developer left on a surface of the image forming body which supports a visible image formed by the magnetic developer. In the cleaning device the residual developer on the image forming body is removed by a porous elastic member which is moved relative to the image forming body.

9 Claims, 6 Drawing Figures

CLEANING DEVICE FOR USE IN AN IMAGE FORMING APPARATUS

BACKGROUND OF THE INVENTION

The present invention relates to a cleaning device for use in an image forming apparatus and, more particularly, to a cleaning device for removing developer from a photosensitive drum after an electrostatic latent image is developed and a developer image is transferred to a copying paper sheet.

An image forming apparatus, particularly an electronic copying apparatus, has an image forming body or photosensitive drum. An electrostatic latent image is formed on the drum and is then developed into a visible image with developer. The visible image is then transferred to a copying paper sheet. Thereafter, the residual developer remaining on the drum is removed therefrom; that is, the drum is cleaned and made ready to form another electrostatic latent image.

Various devices for cleaning photosensitive drums are known and used in practice. One of them has a rotary fur brush which is brought into contact with a photosensitive drum and which is rotated to remove the developer from the drum. Another known cleaning device has an elastic rubber blade which is moved in contact with the periphery of a photosensitive drum to scrape the remaining developer therefrom.

The photosensitive drum comprises a metal cylinder and a photosensitive layer formed on the outer circumferential surface of the cylinder. The photosensitive layer may be a selenium layer vapor-deposited on the outer circumferential surface of the cylinder. Alternatively, it may be formed by coating onto the outer circumferential surface of the cylinder a paint consisting of a resin and cadmium sulfide powder or zinc oxide powder dispersed in the resin. Further, it may be an organic photoconductive layer.

The developer used may be either a one-component developer consisting of toner particles and magnetic particles capsulated in the toner particles or a two-component developer comprising a mixture of toner particles and carrier particles.

A cleaning device is chosen and used according to the type of photosensitive layer used and the kind of developer used.

The known cleaning devices have drawbacks to be described hereinafter. A cleaning device with a fur brush cannot completely remove residual developer from a photosensitive drum when the developer particles are strongly attracted to the photosensitive layer of the drum by an electrostatic force. Cleaning is therefore inadequately performed, particularly when the residual developer is of a one-component type.

A cleaning device with an elastic rubber blade may damage the photosensitive layer of a photosensitive drum, since its blade is strongly pressed against the photosensitive layer. A selenium layer, in particular, may be scratched and may subsequently fail to form a good electrostatic latent image. A compression force of 1 to 2 g/mm is required to press the blade against the selenium layer. If a force less than the above force is applied to the selenium layer, a sufficient cleaning effect cannot be obtained. However, if the photosensitive drum is coated with a protective film such as a polyester film, it is possible to press the blade against the polyester film with a force of 5 to 7 g/mm. Since the force is increased, an improved cleaning effect can be obtained.

However, when a photosensitive drum having such a protective layer thereon is used, a complex PIP method must be used to form an electrostatic latent image, unlike the xerographic copying process.

SUMMARY OF THE INVENTION

The present invention has been made in consideration of the above mentioned circumstances, and has for its object to provide a cleaning device for use in an image forming apparatus, which does not damage an image forming body, yet which completely removes residual developer from the image forming body, thereby effectively cleaning the image forming body.

In order to achieve the above object of the present invention, the residual developer on the image forming body is removed by a porous elastic member which is moved relative to the image forming body.

Furthermore, when a magnetic developer is used, the residual developer is recovered from the porous elastic member using a magnetic force.

DETAILED DESCRIPTION OF THE PREFERRED EMBODIMENT

Figure 1:
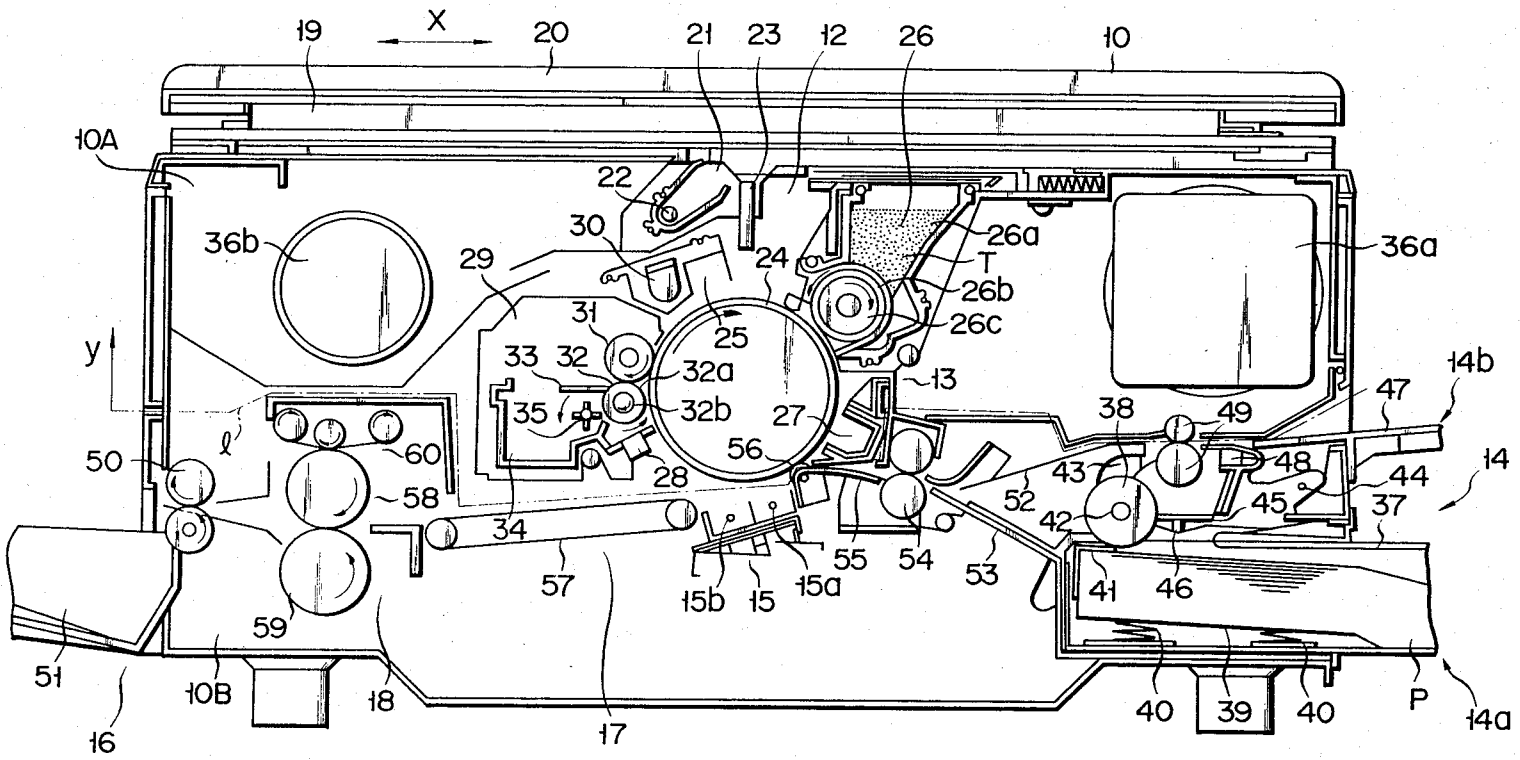
FIG. 1 is a front sectional view schematically showing the internal configuration of an electronic copying machine which has a cleaning device of one embodiment according to the present invention.
Figure 2:
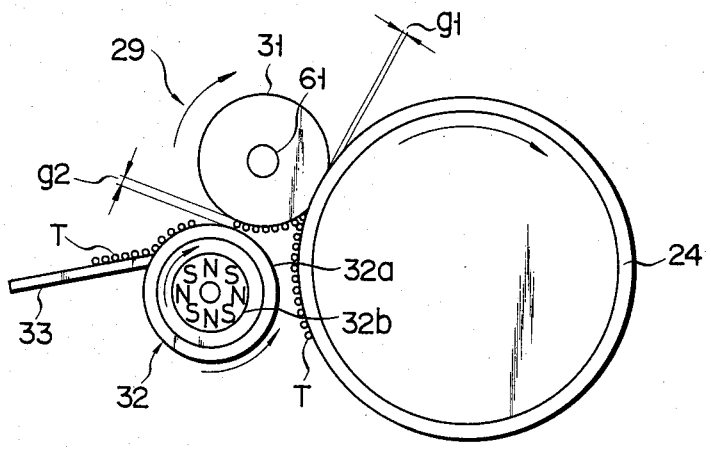
FIG. 2 is a detailed front view of the cleaning device shown in FIG. 1.
Figure 3:
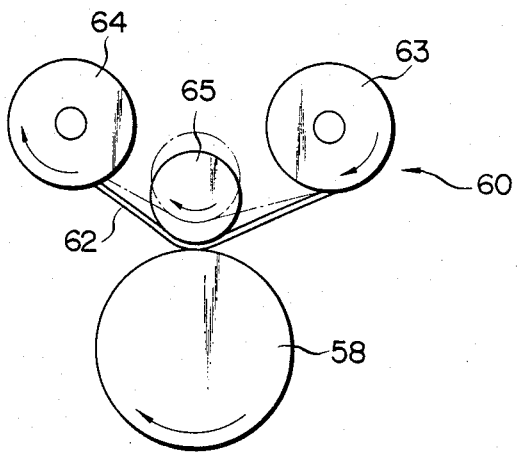
FIG. 3 is a front view of a fixing device shown in FIG. 1.

FIG. 1 is a front sectional view schematically showing an electronic copying machine 10 having a cleaning device of one embodiment according to the present invention. The copying machine 10 comprises an upper unit 10A and a lower unit 10B. One end (right end in FIG. 1) of the upper unit 10A is coupled to one end (right end in FIG. 1) of the lower unit 10B by a shaft 11 to be pivotal about it in a direction indicated by an arrow Y.

A dotted line representing the boundary between the upper and lower units 10A and 10B is indicated by reference symbol l. A convey path is formed to convey a copying paper sheet P along the boundary l between the upper and lower units 10A and 10B. An exposure device 12 and a copying process device 13 are disposed in the upper unit 10A. A paper supply device 14, a transfer/peeling device 15, a paper discharge device 16, a paper convey device 17 and a fixing device 18 are disposed in the lower unit 10.

The devices included in the upper unit 10A will be described in detail.

A document table 19 having a transparent platen which is supported to reciprocate in a direction indicated by an arrow X is disposed on the upper surface of the upper unit 10A. A cover 20 is mounted on the document table 19 to hold a document (not shown) to be copied. The exposure device 12 comprises an exposure lamp 22 for illuminating the document through an upper slit 21 and a focusing light-transmitting fiber assembly 23 for transmitting light reflected from the document to a photosensitive drum 24 on which an electrostatic latent image is formed.

The operation of the exposure device 12 having the above construction will be described. The operator first opens the cover 20 upward and then places a document which is to be copied on the document table 19. When the operator presses a copy switch, the exposure lamp 22 goes on. The document table 19 is slid on the upper unit 10A toward the left to align with the leading end of the document, and is thereafter slid to the right. This reciprocal movement allows exposure of the complete document through the slit 21. The reflected light from the document is transmitted onto the photosensitive drum 24 through the focusing light-transmitting fiber assembly 23. An electrostatic latent image is then formed on the photosensitive drum 24 and then conducted to the copying process device 13.

The photosensitive drum 24, in this embodiment, comprises an aluminum drum having a diameter of 78 mm and a selenium layer vapor-deposited on the outer circumferential surface of the aluminum drum. The photosensitive drum 24 is supported in the upper unit 10A to be rotatable in the clockwise direction.

A means for forming visible image is provided around the outer periphery of the photosensitive drum 24. A charger 25 is disposed at a location which is near to the photosensitive drum 24 and which corresponds to an upstream position from the image forming portion in the clockwise direction. The charger 25 may comprise a known DC corona discharger. The charger 25 allows the outer surface of the photosensitive drum 24 to become uniformly charged so as to give photosensitivity to the photosensitive drum 24. A developer device 26, first and second dis-chargers 27 and 28, a cleaning device 29, and a discharge lamp 30 are disposed in the order named along the clockwise rotational direction of the photosensitive drum 24, in a downstream portion from the image forming portion. The dis-chargers 27 and 28 comprise the same corona dischargers as used for the charger 25.

The developer device 26 develops the electrostatic latent image formed on the photosensitive drum 24. The developer device 26 has a hopper **26*a*, a nonmagnetic sleeve 26*b* and a magnet roller 26*c*. A one-component insulating magnetic developer T (to be referred to as a toner T hereinafter) is contained in the hopper 26*a*. The toner T has an average particle size of 15 $\mu$m. The toner T is supplied to the outer surface of the photosensitive drum 24 upon rotation of the sleeve 26*b* and the magnet roller 26*c*. The sleeve 26*b* is supported to rotate counterclockwise as indicated by an arrow, while the magnet roller 26*c* is supported to rotate clockwise as indicated by an arrow. Upon rotation of the sleeve 26*b* and the magnet roller 26*c*, the toner T is circulated in the hopper 26*a* and is supplied to the sleeve 26*b* to form a thin layer thereon. Then, the toner T is supplied from the sleeve 26*b* to the opposing surface of the photosensitive drum 24**.

The cleaning device 29 removes and recovers the toner left on the surface of the photosensitive drum 24. The cleaning device 29 has a cleaning roller 31 which is made of a porous elastic material. The cleaning roller 31 which will be described later scrapes off the toner T left on the surface of the photosensitive drum 24. The toner removed by the cleaning roller 31 is recovered therefrom by a recovery roller 32. The toner T on the recovery roller 32 is scraped by a blade 33 and is recovered into a recovery box 34. The recovery roller 32 has a nonmagnetic sleeve **32*a* which is rotated counterclockwise, and a magnet roller 32*b* in the non-magnetic sleeve 32*a***, as a magnetic field generating means for generating an alternating magnetic field.

Agitation blades 35 are disposed in the recovery box 34 and are rotated counterclockwise as shown in FIG. 1. The agitation blades 35 allow the recovery box 34 to smoothly recover the toner T.

The operation of the copying process device 13 having the above construction will be described hereinafter.

The charger 25 uniformly charges the surface of the photosensitive drum 24. Upon rotation of the photosensitive drum 24 in the clockwise direction, the exposure device 12 exposes the document. An electrostatic latent image corresponding to an image on the document is formed on the photosensitive drum 24. When the photosensitive drum 24 is further rotated, the electrostatic latent image on the photosensitive drum 24 opposes the developer device 26. The toner T is then attached to the electrostatic latent image to form a visible image. That is, upon rotation of the sleeve **26*b* and the magnet roller 26*c*, the thin layer of the toner T on the sleeve 26*b* is moved to and opposes the electrostatic latent image. The toner T is then charged in a polarity opposite to that of the electrostatic latent image by an electric field formed between the surfaces of the sleeve 26*b* and the photosensitive drum 24**. The toner T thus charged is attracted to the electrostatic latent image by the coulomb force. Thus, the toner T is attached to the photoelectric latent image to form a visible or toner image.

When development is completed, the toner image opposes the first dis-charger 27. At this time, the electrostatic adhesion of the toner T to the photosensitive drum 24 is weakened, thus improving the transfer efficiency. The toner image developed by the developer device 26 is transferred to the copying paper sheet P by the transfer/peeling device 15 to be described later. Even when the transfer is completed, the photosensitive drum 24 continues to rotate. The remaining toner on the photosensitive drum 24 then opposes the second discharger 28. The second dis-charger 28 discharges the photosensitive drum 24 and the remaining toner thereon so as to readily remove the toner T from the photosensitive drum 24.

The toner T left on the photosensitive drum 24 then opposes the cleaning device 29 and is cleaned off. Since the cleaning roller 31 is rotated clockwise in the same manner as the photosensitive drum 24, the opposing surface portions thereof are driven in opposite directions to each other. Thus, the toner T left on the photosensitive drum 24 is scraped off by the cleaning roller 31. The toner T removed by the cleaning roller 31 is then transferred to the recovery roller 32 by the magnetic force of the recovery roller 32. The toner T transferred to the recovery roller 32 is scraped therefrom by the blade 33 and is recovered into the recovery box 34.

The photosensitive drum 24 from which the residual toner T is removed is discharged and is ready for the next copying process.

It is here noted that a motor **36*a* for driving the devices and a fan 36*b* for cooling the copying machine 10 are disposed in the upper unit 10A**.

The devices of the lower unit 10B will be described in detail.

The paper supply device 14 has a cassette paper supply station 14*a* and a manual paper supply station 14*b*. The cassette paper supply station 14*a* comprises a cassette 37 which has stacked copying paper sheets P therein and paper pickup rollers 38 for feeding out each copying paper sheet P from the cassette 37. The cassette 37 has a support plate 39 for supporting the leading ends of the stacked paper sheets P and springs 40 for urging the support plate 39 toward the paper pickup rollers 38. Paper separation pawls 41 are disposed at both sides of the upper leading end of the cassette 37 to regulate the upward movement of the paper sheets P urged by the support plate 39 and the springs 40. The both ends of a shaft 42 which support the paper pickup rollers 38 are supported at brackets 43. The bracket 43 is rotatable about a shaft 44. When the operator inserts the cassette 37 into the copying machine or removes it therefrom, the paper pickup rollers 38 are spaced apart from the cassette 37. One end of a polypropyrene support plate 45 is fixed to the bracket 43. The other end of the support plate 45 is placed on the shaft 42 and is movable upward together with the paper pickup rollers 38. A photosensor 46 is disposed on the support plate 45 to detect an empty state of the cassette 37.

The manual paper supply station 14*b* comprises a guide 47 for manually inserting a copying paper sheet P, a sensor 48 for detecting the leading end of the copying paper sheet P inserted along the guide 47, and paper pickup rollers 49 which are rotated in response to a signal from the sensor 48.

The operation of the paper supply device 14 having the above construction will be described in detail.

When the operator presses the copy switch, the paper pickup rollers 38 are rotated for a predetermined period so as to feed out the uppermost copying paper sheet P from the cassette 37. At this time, the stacked copying paper sheets P are urged by the support plate 39 and the springs 40 upward to be brought into contact with the paper separation pawls 41. Therefore, the overlaid copying paper sheets P are not simultaneously fed out from the cassette 37, thus assuring the feeding of individual copying paper sheets P. When all the copying paper sheets P are fed out from the cassette 37, the sensor 46 detects the empty state of the cassette 37. As a result, the copying operation is stopped.

However, when the operator inserts a copying paper sheet P through the guide 47, the leading end of the copying paper sheet P is detected by the sensor 48. The paper pickup rollers 49 start rotation upon detection by the sensor 48. In this manner, the manually fed copying paper sheet P is conveyed in the copying machine by means of the paper pickup rollers 49.

The copying paper sheet P fed by the paper supply device 14 is conveyed to the transfer/peeling device 15 by the paper convey device 17 and then to the paper discharge device 16 through the fixing device 18. The paper discharge device 16 has paper discharge rollers 50 and a tray 51.

The transfer/peeling device 15 has a transfer charger 15*a* having a DC corona discharger for discharging the copying paper sheet P so that it has the same polarity as the discharger 25, and a peeling charger 15*b* having an AC corona discharger. The transfer charger 15*a* transfers the toner image formed on the surface of the photosensitive drum 24 by the toner T to the copying paper sheet P. The peeling charger 15*b* separates the copying paper sheet P electrostatically attracted to the photosensitive drum 24 therefrom.

The paper convey device 17 has a first guide 52 continuously formed from the delivery port of the manual paper supply station 14*b*, and a second guide 53 continuously formed from the delivery port of the cassette paper supply station 14*a*. The copying paper sheet P conveyed along the first or second guide 52 or 53 is aligned by a pair of register rollers 54. The register rollers 54 are normally stopped, and the leading end of the copying paper sheet P is brought into contact with the register rollers 54. The register rollers 54 start rotation at a time when the photosensitive drum 24 is rotated to a predetermined angular position. The register rollers 54 then convey the copying paper sheet P to the transfer/peeling device 15. The copying paper sheet P conveyed by the register rollers 54 are further conveyed to a position between a guide roller 56 and the photosensitive drum 24 through a guide 55. The guide rollers 56 are constantly urged upward. When the upper unit 10A is closed, the guide rollers 56 are brought into contact with the photosensitive drum 24.

The paper convey device 17 has a belt 57 for attracting the transferred copying paper sheet P thereto and for conveying it to the fixing device 18. The fixing device 18 has a pressure roller 58, a backup roller 59 and a cleaner 60. The pressure roller 58 and the backup roller 59 are respectively rotated in the directions indicated by arrows and are kept in tight contact with each other. The copying paper sheet P then passes between the pressure roller 58 and the backup roller 59 so as to fix the toner image transferred onto the copying paper sheet P. The cleaner 60 removes the toner T from the pressure roller 58 which is contaminated with the toner T during the fixing process, thereby cleaning the pressure roller 58. As a result, the pressure roller 58 is ready for the next fixing operation.

The cleaning device 29 of the one embodiment according to the present invention will be described in detail. The arrangement of the cleaning roller 31 and the recovery roller 32 in the cleaning device 29 will be described with reference to FIGS. 2 to 5.

The cleaning roller 31 is made of a porous elastic material having uniform pores formed into a roller. A shaft 61 is fixed to the cleaning roller 31 to be coaxial therewith. The porous elastic material may be a foam of polyurethane, silicone rubber, nitrilobutadiene rubber, natural rubber, chloroprene rubber or an ethylene-propylene copolymer. A cellular type foam is preferred to a non-cellular type foam. The non-cellular type foam is a material such as a sponge which is generally called a moltprene sponge and which has interconnecting pores. However, the cellular type foam is a material such as a neoprene sponge (foam of chloroprene sponge) having cells which do not communicate with each other.

A cellular type foam is preferred here for the following reasons. The toner T scraped from the photosensitive drum 24 is retained in the pores between the closed cells of the cleaning roller 31 in order to be conveyed thereby. However, if a non-cellular type foam is used, the toner T permeates into deeper pores of the cleaning roller. Thus, the toner T cannot be recovered from the cleaning roller 31. However, when a cellular type foam is used, the toner T does not permeate deep inside the cleaning roller, thus guaranteeing recovery of the toner T.

Furthermore, since the cleaning roller 31 directly contacts the photosensitive drum 24, the cleaning roller 31 must have a hardness which does not allow damage to the surface of the photosensitive drum 24. According to experiments conducted by the present inventors, using a photosensitive drum 24 which comprised a cylinder and a selenium photosensitive layer vapor-deposited thereon, had a diameter of 78 mm, and was rotated clockwise at a speed of 130 mm/sec, a cleaning roller 31 which had a surface density of 10 to 40 kg/m$^3$ was found to be suitable. When the above surface density is selected, the surface of the photosensitive drum 24 may not be damaged by the cleaning roller 31. The degree of damage to the photosensitive drum 24 is also influenced by the pressure applied between the cleaning roller 31 and the photosensitive drum 24 and the rotational frequency of the cleaning roller 31.

When the pressure applied by the cleaning roller 31 is low, the toner T cannot be properly scraped from the photosensitive drum 24. However, when the pressure is too high, the surface of the photosensitive drum 24 is damaged or the service life of the cleaning roller 31 is extremely shortened.

According to experiments conducted by the present inventors, a chloroprene rubber foam called a neoprene sponge was used and formed into a roller having a diameter 28 mm. Thus, the cleaning roller 31 was prepared. A shaft 61 having a diameter of 8 mm was axially inserted along the cleaning roller 31. The density of the neoprene sponge was 10 to 40 kg/m$^3$. When the cleaning roller 31 was brought into tight contact with the photosensitive drum 24, a gap g1 between the cleaning roller 31 and the photosensitive drum 24 was suitably within a range of $-5$ mm$<$g1$<0$ mm (the minus sign indicates an inward deformation amount of the cleaning roller 31 when it is pressed against the photosensitive drum 24).

The cleaning efficiency of the cleaning roller 31 is improved when the rotational frequency of the cleaning roller 31 is increased. However, it was found that no problem occurred when the cleaning roller 31 was rotated counterclockwise at a speed of 100 rpm.

The recovery roller 32 will now be described. The recovery roller 32 recovers the toner T from the cleaning roller 31. Since the one-component magnetic developer is used as the toner T, the toner T is removed from the cleaning roller 31 by the magnetic force. As described above, the recovery roller 31 has a hollow sleeve 32*a* and a magnet roller 32*b* the latter of which is coaxially mounted within the former. A stainless steel sleeve having a diameter of 24 mm and a magnet roller whose six-pole magnetic force was 1,100 gausses were used. A gap g2 between the sleeve 32*a* and the cleaning roller 31 was within a range of $-2$ mm$<$g2$<5$ mm. Since the toner T is attracted by the magnetic force from the cleaning roller 31 to the sleeve 32*a*, the sleeve 32*a* need not be brought into contact with the cleaning roller 31. This structure allows the cleaning roller 31 to have a greatly prolonged service life.

The rotational frequencies of the sleeve 32*a* and the magnet roller 32*b* will now be described. The cleaning roller 31 is preferably rotated as fast as possible. Upon fast rotation of the magnet roller 32*b*, an alternating magnetic field which abruptly changes acts on the toner T, so that the toner T can be removed from the cleaning roller 31. The removed toner particles orbit freely and are moved along the sleeve 32*a* upon rotation of the magnet roller 32*b*. Therefore, the efficiency of conveying the toner T is improved. The rotational frequency of the sleeve 32*a* influences the travel speed of the toner T and the separation efficiency of the toner T from the cleaning roller 31. Therefore, the rotational frequency of the sleeve 32*a* must be properly set.

According to experiments conducted by the present inventors in consideration of the above items, if the rotational frequency of the cleaning roller 31 is preferably about 100 rpm, the rotational frequency of the sleeve 32*a* is preferably about 50 rpm which is half the rotational frequency of the cleaning roller 31. The rotational frequency of the magnet roller 32*b* is preferably about 500 rpm which is ten times the rotational frequency of the cleaning roller 31. The ratio of the rotational frequency of the sleeve 32*a* to that of the magnet roller 32*b* is preferably larger than 1:2.

The distal end of the blade 33 is brought into light contact with the sleeve 32*a*. The blade 33 is made of a nonmagnetic material such as stainless steel.

The operation of the cleaning device 29 having the structure described above will now be described.

The toner T left on the surface of the photosensitive drum 24 is mechanically scraped therefrom by the cleaning roller 31 since the cleaning roller 31 is rotated in the direction opposite to that of the photosensitive drum 24 at their contact portions. The scraped off toner T is retained in pores e which are open to the surface of the cleaning roller 31 and is conveyed therein.

The toner T retained on the cleaning roller 31 receives the alternating magnetic field formed by the magnet roller 32*b* at the nearest position to the sleeve 32*a*. The magnetic field toward the sleeve 32*a* is applied to the toner T. An abrupt change in the alternating magnetic field upon fast rotation of the magnet roller 32*b* makes it possible to agitate the toner particles. Therefore, the toner T can be readily removed from the cleaning roller 31.

In this manner, after the toner T is removed from the cleaning roller 31 and is attracted to the surface of the sleeve 32*a*, the toner T is retained on the surface of the sleeve 32*a* and is conveyed upon rotation of the sleeve 32*a*. At this time, the toner particles orbit freely along the rotational direction of the sleeve 32*a* when the magnet roller 32*b* is rotated in the direction opposite to that of the sleeve 32*a*. Thus, the travel speed of the toner T is increased. The toner T conveyed by the sleeve 32*a* is scraped by the blade 33 and is recovered into the recovery box 34.

A pressure fixing is operated in the fixing device 18 in the electronic copying machine 10. The fixing device 18 has the pressure roller 58 and the backup roller 59, as described above. The copying paper sheet P onto which an image is transferred is clamped between the pressure roller 58 and the backup roller 59. Thus, the toner T is fixed on the copying paper sheet P. Since the surface of the copying paper sheet P which has a toner image thereon opposes the pressure roller 58, part of the toner T may become attached to the pressure roller 58 during the fixing process. When the toner T attached to the surface of the pressure roller 58 is left there during further copying operations, the toner T adheres firmly to its surface, thus roughening its surface. As a result, irregular fixing occurs and the copying paper sheet P may be jammed between the pressure roller 58 and the backup roller 59.

The cleaner 60 is disposed to eliminate the above drawbacks. The cleaner 60 has a web roller 63 having a nonwoven cleaning web 62 thereon, a take-up roller 64 for taking up the cleaning web 62, and a press roller 65 for pressing the cleaning web 62 against the pressure roller 58. The web roller 63, the take-up roller 64, and the press roller 65 are rotated clockwise in FIG. 3.

Figure 4:
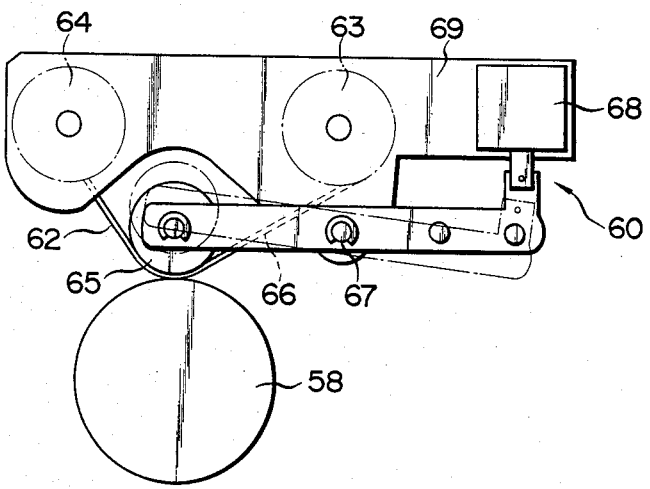
FIG. 4 is a detailed front view of the fixing device shown in FIG. 3.
Figure 5:
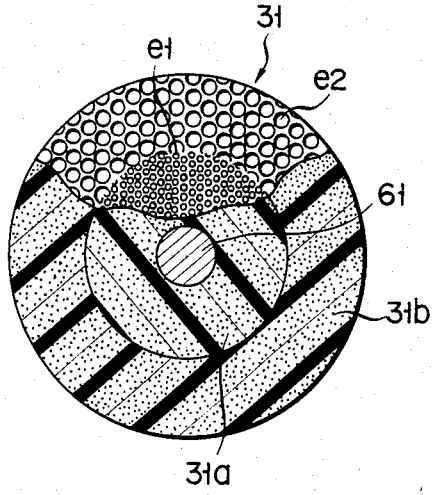
FIG. 5 is a partial sectional view showing a first modification of a cleaning roller shown in FIG. 2.

The press roller 65 is supported to move between a position indicated by the dotted line where the cleaning web 62 is separated from the pressure roller 58 and a position indicated by the solid line where the cleaning web 62 is brought into contact with the pressure roller 58. In this manner, the cleaning web 62 is selectively brought into contact with the pressure roller 58. The press roller 65 is supported at one end of a lever 66, as shown in FIG. 4. The central portion of the lever 66 is rotatable about a shaft 67. A solenoid 68 is mounted at the other end of the lever 66. The solenoid 68 is fixed on a subframe 69. The web roller 63 and the take-up roller 64 are rotatably supported on the subframe 69.

The take-up roller 64 is intermittently rotated clockwise by a driving source (not shown). The web roller 63 and the press roller 65 are driven rollers.

The operation of the cleaner 60 having the above structure will be described. When the operator presses the copy switch, the take-up roller 64 starts rotation and the solenoid 68 is energized. The lever 66 is then rotated about the shaft 67 counterclockwise, so that the cleaning web 62 is brought into tight contact with the pressure roller 58. The cleaning web 62 is moved from the right to the left in FIG. 4 and is slidable along the pressure roller 58. As a result, the toner T attached to the surface of the pressure roller 58 is removed.

When copying is finished, the take-up roller 64 is stopped and the solenoid 68 is de-energized. The press roller 65 and hence the cleaning web 62 are then separated from the pressure roller 58.

The press roller 65 having the same structure as the cleaning roller 31 is used in the cleaner 60. This structure makes it possible to adjust the pressure applied to the cleaning web 62 which is brought into tight contact with the pressure roller 58. Therefore, the surface of the pressure roller 58 is prevented from being damaged by the cleaner 60. The pressure roller 58 generally compresses a roller having a surface with a mirror surface finish so as to apply a uniform pressure to the copying paper sheet P in the fixing process. When the surface of the pressure roller 58 is damaged, a clear image cannot be obtained. However, the press roller 65 of the cleaner 60 of one embodiment according to the present invention will not give rise to such trouble.

In the above one embodiment, cleaning is performed by the cleaner 60 every time one copying operation is performed. However, cleaning may be performed every time a number of copying operations are performed.

The present invention is not limited to the particular embodiment described. Various changes and modifications may be made within the spirit and scope of the present invention. Two modifications of the present invention will be described with reference to FIGS. 5 and 6, respectively.

In the above embodiment, for the cleaning roller 31, a porous elastic material having uniform pores is used to form a roll. However, the cleaning roller 31 is not limited to the above structure. According to the first modification shown in FIG. 5, a cleaning roller 31 has a two-layer structure. The cleaning roller 31 has a first layer 31*a* and a second layer 31*b* formed thereover. First pores e1 of the first layer 31*a* are smaller than second pores e2 of the second layer 31*b*. The first and second pores e1 and e2 are uniformly arranged. Furthermore, the second layer 31*b* is set to be soft. In the first modification, the second layer 31*b* comprises a neoprene sponge having a density of 57 kg/m$^3$ and 55 to 65 cells per inch. The above structure does not allow permeation of the toner T inside the cleaning roller 31. If the toner T permeates into the inside of the cleaning roller 31, the hardness and elasticity of the neoprene sponge as a whole are changed. As a result, the cleaning efficiency is degraded. However, the cleaning roller according to the first modification prevents such a drawback.

Figure 6:
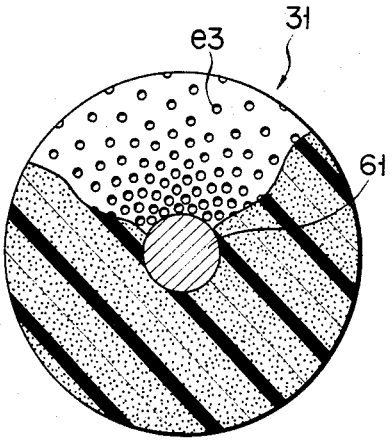
FIG. 6 is a partial sectional view showing a second modification of the cleaning roller shown in FIG. 2.

According to a second modification shown in FIG. 6, the cleaning roller 31 comprises a single layer structure of a foam. Pores e3 are denser toward the shaft 61 or the central axis of the cleaning roller 31. The cleaning roller of the second modification has the same effect as that of the first modification. Furthermore, according to the second modification, since the cleaning roller 31 has a single layer structure, unstable operation may not be performed, unlike the cleaning roller of the first modification where deviations may occur at the boundary between the first and second layers 31*a* and 31*b*. Thus, excellent cleaning efficiency is guaranteed for a long period of time.

In summary, the following effects can be obtained according to the present invention.

(1) Since the toner is removed from the image forming body by the porous elastic member and is retained in the porous elastic member to clean the image forming body, the cleaning efficiency is greatly improved. Furthermore, the toner will not scatter during cleaning.

(2) Since the porous elastic member is used as the cleaning member, the damping effect on pressure against the image forming body is greatly increased. As a result, the image forming body will not be damaged.

The cleaning device of the present invention has an advantage in that it may be suitably used for an image forming body having no protective layer thereon.

In particular, when an elastic roller made of foam is used as a porous elastic member, cleaning is performed by simply rotating the cleaning roller. Furthermore, the cleaning roller can be easily formed. For these reasons, no special means is required for disposing the cleaning member with respect to the image forming drum.

(3) Since the porous elastic member is used as the cleaning member, cleaning is completely performed, unlike the conventional fur brush when one-component insulating developer is used. In this case, due to the magnetic field generating means, the developer particles can be easily removed from the porous elastic member. Therefore, the developer may not permeate into the inside of the porous elastic member, so that the porous elastic member can be constantly used under optimum conditions.

(4) Further, since the means for generating an alternating magnetic field is used as the magnetic field generating means, the removing efficiency of the developer from the porous elastic member is greatly improved.

What is claimed is:

1. A cleaning device for cleaning an image forming body by removing residual magnetic developer left on a surface of said image forming body which supports a visible image formed by the magnetic developer, after a transfer operation is finished, said cleaning device comprising:

rotatable cleaning roller means having a portion in contact with said image forming body, said cleaning roller means including a porous elastic member having a number of pores therein for retaining the residual magnetic developer left on the surface of said image forming body to remove the residual magnetic developer from the surface thereof, thereby cleaning said image forming body; and rotatable recovery roller means disposed in opposing relationship to said cleaning roller means to establish with said cleaning roller means a transfer gap to predetermined dimension, said recovery roller means for recovering the magnetic developer contained in said pores of said cleaning roller means, said recovery roller means including a nonmagnetic sleeve and magnetic field generating means disposed in said sleeve for generating a magnetic field to cause the magnetic developer retained by said cleaning roller means to be transferred to said sleeve across said transfer gap to thereby recover the magnetic developer from said cleaning roller.

2. The cleaning device according to claim 1, wherein said porous elastic member comprises a cellular type foam having a number of pores which do not communicate with each other.

3. The cleaning device according to claim 2, wherein said pores are uniformly dispersed in said porous elastic member.

4. The cleaning device according to claim 2, wherein said pores are dispersed such that a density thereof is increased toward a center of said porous elastic member.

5. The cleaning device according to claim 2, wherein said porous elastic member comprises a first layer having a number of small pores and a second layer having a number of large pores, said second layer being formed to surround said first layer.

6. The cleaning device according to claim 1, wherein said magnetic generating means includes a rotatable magnet roller means for generating an alternating magnetic field.

7. The cleaning device according to claim 6, wherein said image forming body is rotated in one direction, said cleaning roller means is rotated in a direction opposite to said one direction at said portion at which said cleaning roller contacts said image forming body, said sleeve is rotated in said one direction, and said magnet roller means is rotated in a direction opposite to said one direction.

8. A cleaning device for cleaning an image forming body by removing residual magnetic developer remaining on an image forming surface of said image forming body, said cleaning device comprising:

rotatable cleaning roller means having a portion in contact with said image forming surface of said image forming body for cleaning said residual magnetic developer from said image forming surface and including means defining pores for retaining the residual magnetic developer removed from said image forming surface; and recovery roller means rotatably mounted in opposing relationship to said cleaning roller means for recovering the magnetic developer retained in said pores by transfer of the magnetic developer from said cleaning roller means to said recovery roller means, said recovery roller means including (a) outer sleeve means rotatable in a predetermined direction for defining a transfer surface to accept the magnetic developer transferred from said cleaning roller means, and (b) magnet means coaxially housed within said outer sleeve means and rotatable in a direction opposite to said predetermined direction, said magnet means for generating a magnetic field to cause the magnetic developer retained in said pores to be transferred to said transfer surface whereby the magnetic developer is recovered; and wherein said roller means is mounted to define a transfer gap of predetermined dimension with said cleaning roller means and wherein said magnet means causes the magnetic developer to be transferred across said transfer gap.

9. The cleaning device as in claim 8 wherein said magnet means includes a rotatable magnet roller means for generating an alternating magnetic field.

* * * * *